US011739591B2

(12) United States Patent
Zhang

(10) Patent No.: US 11,739,591 B2
(45) Date of Patent: Aug. 29, 2023

(54) ADJUSTABLE ROLLER SHADES

(71) Applicant: Jiwen Zhang, Nanyang (CN)

(72) Inventor: Jiwen Zhang, Nanyang (CN)

(73) Assignee: Nanyang Kunyuan Intelligent Technology Co., Ltd., Nanyang (CN)

( * ) Notice: Subject to any disclaimer, the term of this patent is extended or adjusted under 35 U.S.C. 154(b) by 0 days.

(21) Appl. No.: 17/886,721

(22) Filed: Aug. 12, 2022

(65) Prior Publication Data

US 2023/0066498 A1 Mar. 2, 2023

Related U.S. Application Data

(63) Continuation-in-part of application No. 17/412,025, filed on Aug. 25, 2021.

(51) Int. Cl.

| | |
|---|---|
| ***E06B 9/64*** | (2006.01) |
| ***E06B 9/68*** | (2006.01) |
| ***E06B 9/42*** | (2006.01) |

(52) U.S. Cl.

CPC ..... *E06B 9/68* (2013.01); *E06B 9/42* (2013.01); *E06B 9/64* (2013.01); *E06B 2009/6809* (2013.01)

(58) Field of Classification Search

CPC ..... E06B 9/68; E06B 2009/6809; E06B 9/56; E06B 9/42; E06B 9/64; E06B 9/70; E06B 9/74

See application file for complete search history.

(56) References Cited

U.S. PATENT DOCUMENTS 13,482 A * 8/1855 Crooke ..... E06B 9/42 160/256
219,110 A * 9/1879 Nissley ..... E06B 9/42 160/256

FOREIGN PATENT DOCUMENTS

CN 108533162 A * 9/2018 ..... E06B 9/40

* cited by examiner

*Primary Examiner* — Abe Massad
*Assistant Examiner* — Jeremy C Ramsey
(74) *Attorney, Agent, or Firm* — Ming Jiang; MM IP SERVICES LLC

(57) ABSTRACT

Present disclosure relates to an adjustable roller shade. Adjustable roller shade includes: roller shade fabric winding shaft, weight, movable pulley, loop traction rope, a first and a second winders, and a first and a second tensioning wheels. Roller shade fabric is wound on roller shade fabric winding shaft forming upper edge of adjustable roller shade. Weight is attached to bottom of roller shade fabric forming lower edge of adjustable roller shade. Movable pulley is fixedly attached to one end of the roller shade fabric winding shaft. Loop traction rope is wound around the movable pulley, the first and second winders, and the first and second tensioning wheels. A driving motor drives first winder to rotate in different combination of directions to raise or lower upper edge and lower edge of adjustable roller shade, resulting adjustable roller shade to be opened or closed freely from both upper and lower edges.

7 Claims, 5 Drawing Sheets

ADJUSTABLE ROLLER SHADES

FIELD

The invention relates to a window covering, in particular to adjustable roller shades to be freely opened and closed both from top and/or bottom.

BACKGROUND

The roller shade is convenient to use, attractive and elegant, and is widely used both in homes and office environments. The roller shades currently on the market is generally mounted at the top of the window, using a scroll to roll up and down to open the roller shades from the bottom. When such roller shades are opened partially, the lower portion of the room is exposed and natural light from the upper portion is blocked.

It is desirable to have a roller shade that can open a lower portion, an upper portion, or both lower and upper portion of the window to meet user's needs to open any portion of the window.

Therefore, an unaddressed need exists in the art to address the aforementioned deficiencies and inadequacies.

SUMMARY

In one aspect, the present disclosure relates to an adjustable roller shade. In certain embodiments, the adjustable roller shade includes: a roller shade fabric winding shaft, a weight, a movable pulley, a traction rope, a first winder and a second winder. A roller shade fabric is wound on the roller shade fabric winding shaft forms an upper edge of the adjustable roller shade, and the weight attached to a bottom of the roller shade fabric forming a lower edge of the adjustable roller shade. The movable pulley is fixedly attached to a first end of the roller shade fabric winding shaft. The traction rope includes an upward lifting section, a first connecting section, a downward pulling section, and a second connecting section. The upward lifting section, the first connecting section, the downward pulling section, and the second connecting section are connected forming a closed loop.

The upward lifting section goes from the first winder, under the movable pulley, connects to the first connecting section over the second winder, the first connecting section connects to the downward pulling section under a second tensioning wheel, the downward pulling section goes over the movable pulley, connects to the second connecting section under a first tensioning wheel, the second connecting section connects back to the upward lifting section over the first winder, forming the closed loop.

In certain embodiments, the traction rope includes: a rope, a bead chain, or a belt.

In certain embodiments, the first winder is driven by a driving motor, and the driving motor is controlled by a controller.

In certain embodiments, when the second winder is engaged with the first winder through a clutch device, the second winder is driven by the engaged first winder, and when the second winder is engaged with a gear set through the clutch device, the second winder rotate passively due to the closed loop traction rope. The gear set and the clutch device are controlled by the controller.

In certain embodiments, the controller receives control commands from a control device. The control device includes: a manual control device, a control switch, and a remote control. The adjustable roller shade is operated by a user using the control device and the upper edge and the lower edge of the adjustable roller shade may be adjusted separately and independently.

In certain embodiments, when the first winder is disengaged with the second winder, and the second winder is engaged with the gear set through the clutch device, the user adjusts the lower edge the adjustable roller shade to go up or down.

When the first winder is driven by the driving motor to rotate clockwise and the second winder rotates counter-clockwise due to the close loop of the traction rope, the traction rope causes the movable pulley to rotate counter-clockwise and the roller shade fabric rolls in counter-clockwise direction around the roller shade fabric winding shaft, and the lower edge of the adjustable roller shade rises.

When the first winder is driven by the driving motor to rotate counter-clockwise and the second winder rotates clockwise due to the close loop of the traction rope, the traction rope causes the movable pulley to rotate clockwise and the roller shade fabric rolls in clockwise direction around the roller shade fabric winding shaft, and the lower edge of the adjustable roller shade lowers.

In certain embodiments, when the first winder is engaged with the second winder through the clutch device, the user adjusts the upper edge the adjustable roller shade to go up or down.

When the first winder is driven by the driving motor to rotate clockwise, the second winder is driven by the first winder through the clutch device to rotate clockwise simultaneously, the upward lifting section of the traction rope lengthens, and the traction rope causes the movable pulley to move downward, and the upper edge of the adjustable roller shade lowers.

When the first winder is driven by the driving motor to rotate counter-clockwise, the second winder is driven by the first winder through the clutch device to rotate counter-clockwise simultaneously, the upward lifting section of the traction rope shortens, the traction rope causes the movable pulley to move upward, and the upper edge of the adjustable roller shade rises.

In certain embodiments, a second movable pulley is fixedly attached to a second end of the roller shade fabric winding shaft. A second traction rope goes through a third winder, a fourth winder, a third tensioning wheel, and a fourth tensioning wheel, at the second movable pulley and the second end of the roller shade fabric winding shaft.

In certain embodiments, the movable pulley and the second movable pulley, the first winder, the second winder, the third winder, and fourth winder, the first tensioning wheel, the second tensioning wheel, the third tensioning wheel, and fourth tensioning wheel are installed in two guide grooves located on each of the first end and the second end of the roller shade fabric winding shaft, symmetrically to maintain balance of the adjustable roller shade.

In certain embodiments, the gear set and the clutch device are installed on one side of the guide grooves. The third winder is driven by the first winder through a first transmission rod and the fourth winder are driven by the second winder through a second transmission rod.

These and other aspects of the present disclosure will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
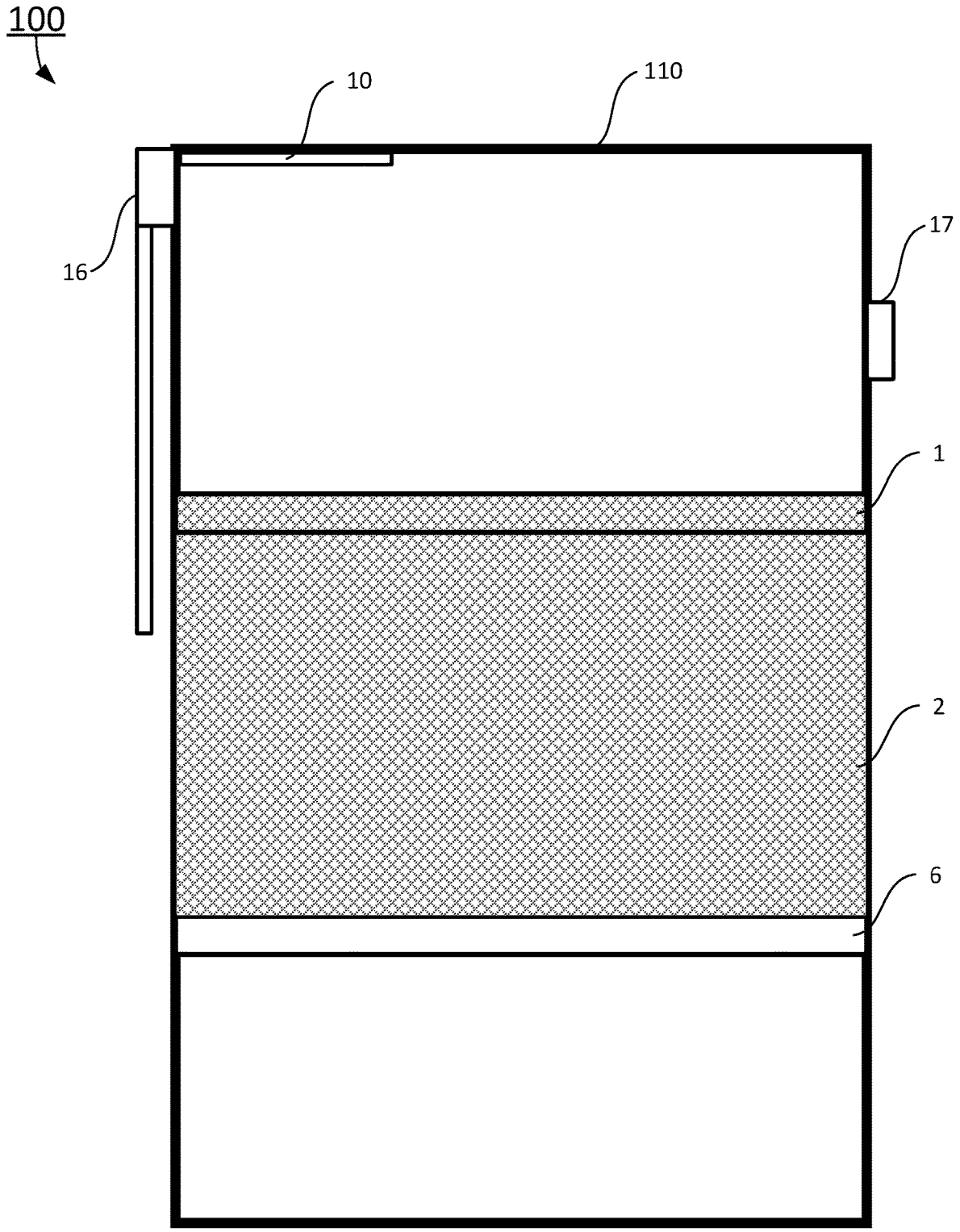
FIG. 1 is a schematic structural view of an exemplary adjustable roller shade according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 5.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 5.

Figure 2:
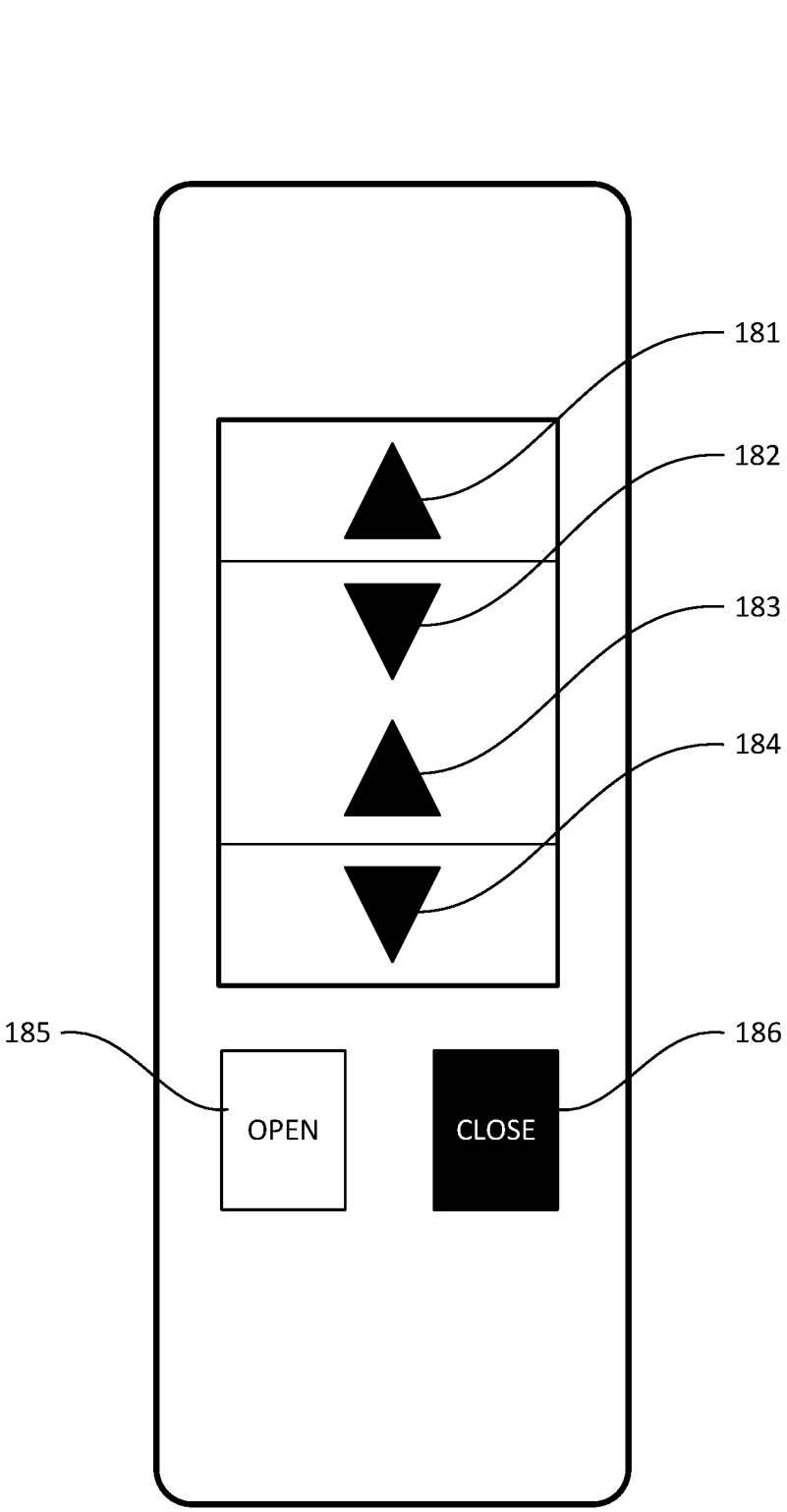
FIG. 2 is a front view of a remote control for controlling the adjustable roller shade according to certain embodiments of the present disclosure.

As shown in FIG. 1, an adjustable roller shade 100 is installed on a window 110. The adjustable roller shade 100 has a roller shade fabric winding shaft 1 where a roller shade fabric 2 is rolled around the roller shade fabric winding shaft 1 to form an upper edge of the adjustable roller shade 100. A weight 6 is attached to a bottom of the roller shade fabric 2 to keep the roller shade fabric 2 straight and to form a lower edge of the adjustable roller shade 100. The upper edge and the lower edge of the adjustable roller shade 100 may be adjusted separately and independently according to users' desires and have the flexibilities of opening the roller shade at a top portion, a bottom portion, or both top portion and bottom portion of the window 110. The adjustable roller shade 100 can be controlled by a manual control device 16, a control switch 17, and a remote control 18 as shown in FIG. 2. The upper edge and the lower edge of the adjustable roller shade 100 may be independently adjusted, and separately adjusted.

In certain embodiments, as shown in FIG. 2, the remote control 18 has four directional control buttons: a first up button 181 and a first down button 182 for controlling the upper edge of the adjustable roller shade 100, and a second up button 183 and a second down button 184 for controlling the lower edge of the adjustable roller shade 100. These buttons can be pressed at the same time to cause simultaneous movements of the adjustable roller shade 100. Remote control 18 also has a one-key open button 185 to open the adjustable roller shade 100 completely by pressing only one key, and one-key close button 186 to close the adjustable roller shade 100 completely by pressing only one key.

Figure 3:
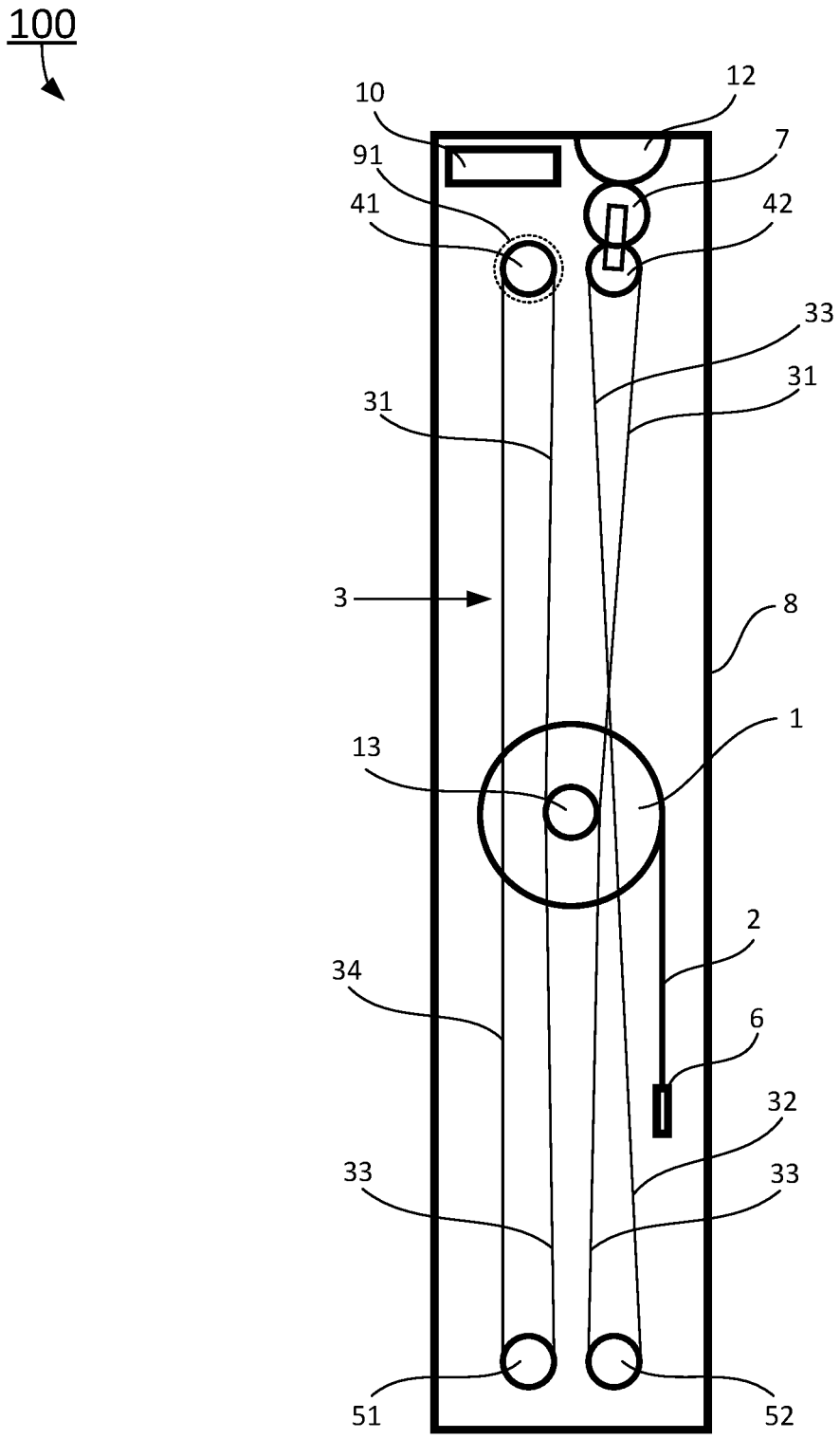
FIG. 3 shows a side view of an exemplary adjustable roller shade when two winders are disengaged according to one embodiment of the present disclosure.
Figure 4:
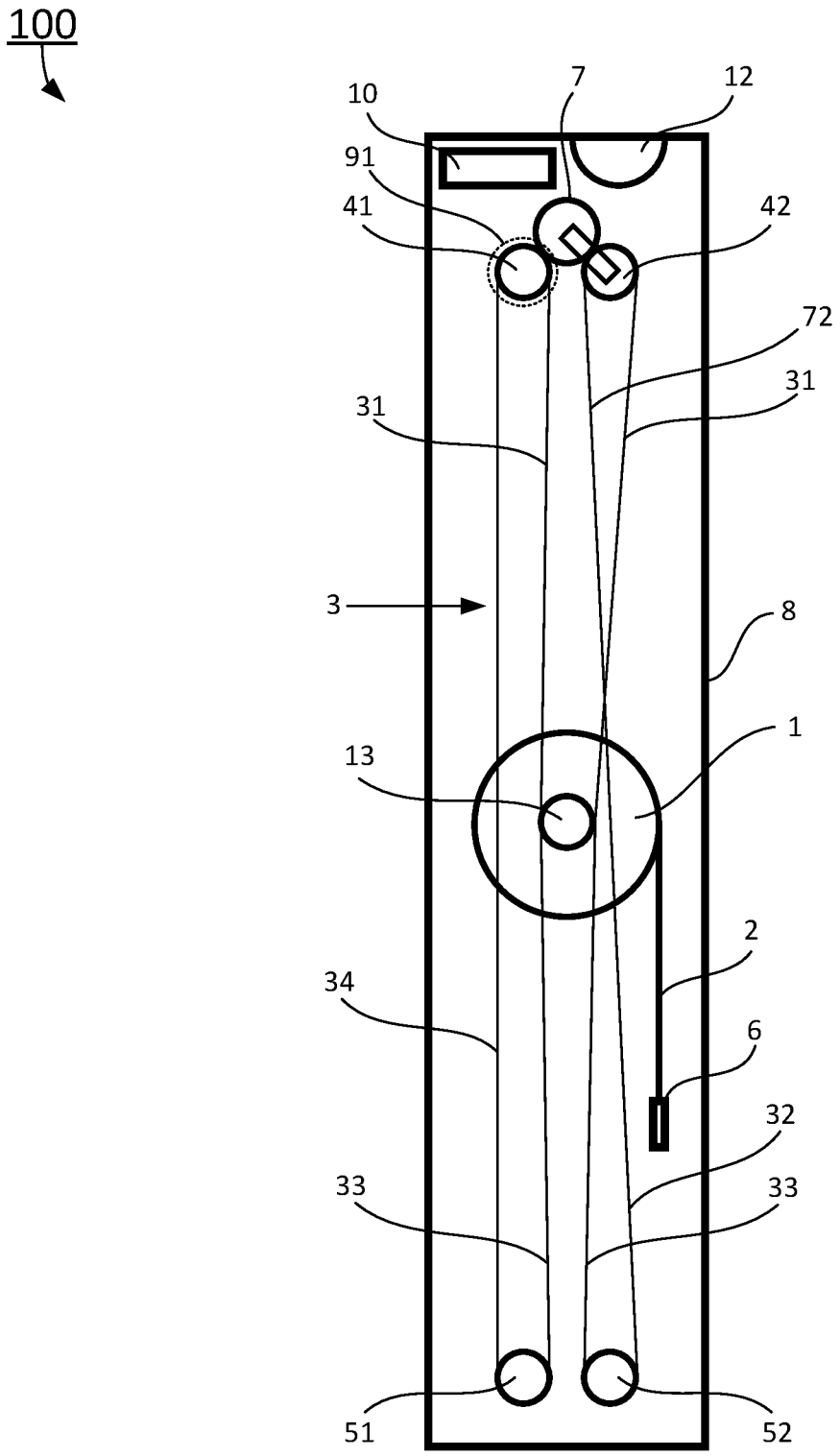
FIG. 4 shows the side view of the exemplary adjustable roller shade when two winders are engaged according to another embodiment of the present disclosure.

In one aspect, as shown in FIGS. 3-4, the present disclosure relates to an adjustable roller shade 100. In certain embodiments, the adjustable roller shade 100 includes: a roller shade fabric winding shaft 1, a weight 6, a movable pulley 13, a traction rope 3, a first winder 41 and a second winder 42. A roller shade fabric 2 is wound on the roller shade fabric winding shaft 1 forms an upper edge of the adjustable roller shade 100, and the weight 6 attached to a bottom of the roller shade fabric 2 forming a lower edge of the adjustable roller shade 100. The movable pulley 13 is fixedly attached to a first end of the roller shade fabric winding shaft 1. The traction rope 3 includes an upward lifting section 31, a first connecting section 32, a downward pulling section 33, and a second connecting section 34. The upward lifting section 31, the first connecting section 32, the downward pulling section 33, and the second connecting section 34 are connected forming a closed loop.

In certain embodiments, the upward lifting section 31 goes from the first winder 41, under the movable pulley 13, connects to the first connecting section 32 over the second winder 42, the first connecting section 32 connects to the downward pulling section 33 under a second tensioning wheel 52, the downward pulling section 33 goes over the movable pulley 13, connects to the second connecting section 34 under a first tensioning wheel 51, the second connecting section 34 connects back to the upward lifting section 31 over the first winder 41, forming the closed loop.

In certain embodiments, the traction rope 3 should have minimum stretchability. In one embodiment, the traction rope 3 is a nylon rope. In another embodiment, the traction rope 3 is a bead chain. In yet another embodiment, the traction rope 3 is a belt.

In certain embodiments, as shown in FIGS. 3-4, the first winder 41 is driven by a driving motor 91, and the driving motor 91 is controlled by a controller 10.

In certain embodiments, when the second winder 42 is engaged with the first winder 41 through a clutch device 7, the second winder 42 is driven by the engaged first winder 41. When the second winder 42 is engaged with a gear set 12 through the clutch device 7, the second winder 42 rotate passively due to the closed loop traction rope 3. The gear set 12 and the clutch device 7 are controlled by the controller 10.

In certain embodiments, the controller 10 receives control commands from a control device. The control device includes: a manual control device 16, a control switch 17, and a remote control 18. The adjustable roller shade 100 is operated by a user using the control device and the upper edge and the lower edge of the adjustable roller shade 100 may be adjusted separately and independently.

In certain embodiments, the controller 10 receives control commands from a control device. The control device includes: a manual control device 16, a control switch 17, and a remote control 18. In one embodiment, the controller 10 receives control commands from the manual control device 16. In another embodiment, the controller 10 receives control commands from the control switch 17 attached to the window frame as shown in FIG. 1. In yet another embodiment, the controller 10 receives control commands from the remote control 18 as shown in FIG. 2.

The adjustable roller shade 100 is operated by a user using the control device and the upper edge and the lower edge of the adjustable roller shade 100 may be adjusted separately and independently.

In certain embodiments, as shown in FIG. 3, the first winder 41 is disengaged with the second winder 42, and the second winder 42 is engaged with the gear set 12 through the clutch device 7, the user adjusts the lower edge the adjustable roller shade 100 to go up or down.

When the first winder 41 is driven by the driving motor 91 to rotate clockwise and the second winder 42 rotates passively counter-clockwise due to the close loop of the traction rope 3, the traction rope 3 causes the movable pulley 13 to rotate counter-clockwise and the roller shade fabric 2 rolls in counter-clockwise direction around the roller shade fabric winding shaft 1, and the lower edge of the adjustable roller shade 100 rises.

When the first winder 41 is driven by the driving motor 91 to rotate counter-clockwise and the second winder 42 rotates passively clockwise due to the close loop of the traction rope 3, the traction rope 3 causes the movable pulley 13 to rotate clockwise and the roller shade fabric 2 rolls in clockwise direction around the roller shade fabric winding shaft 1, and the lower edge of the adjustable roller shade 100 lowers.

In certain embodiments, as shown in FIG. 4, the first winder 41 is engaged with the second winder 42 through the clutch device 7 and both first winder 41 and second winder 42 rotate in the same direction, the user adjusts the upper edge the adjustable roller shade 100 to go up or down.

When the first winder 41 is driven by the driving motor 91 to rotate clockwise, the second winder 42 is driven by the first winder 41 through the clutch device 7 to rotate clockwise simultaneously, the upward lifting section 31 of the traction rope 3 lengthens, and the traction rope 3 causes the movable pulley 13 to move downward, and the upper edge of the adjustable roller shade 100 lowers.

When the first winder 41 is driven by the driving motor 91 to rotate counter-clockwise, the second winder 42 is driven by the first winder 41 through the clutch device 7 to rotate counter-clockwise simultaneously, the upward lifting section 31 of the traction rope 3 shortens, the traction rope 3 causes the movable pulley 13 to move upward, and the upper edge of the adjustable roller shade 100 rises.

Figure 5:
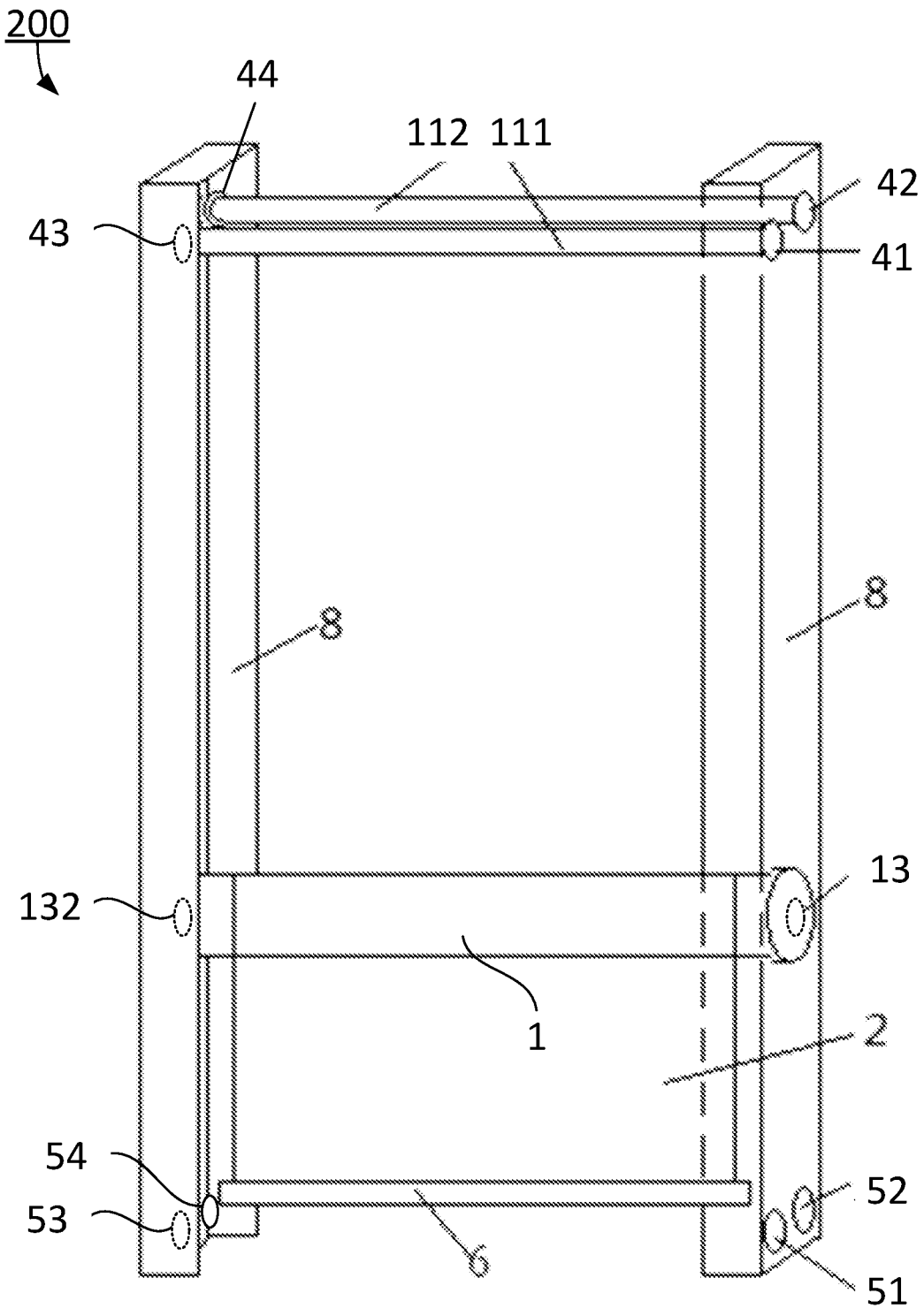
FIG. 5 is a schematic view of the overall installation structure of adjustable roller shade according to certain embodiments of the present disclosure.

In certain embodiments, as shown in FIG. 5, a second movable pulley 132 is fixedly attached to a second end of the roller shade fabric winding shaft 1. A second traction rope 35 (not shown in FIG. 5) goes through a third winder 43, a fourth winder 44, a third tensioning wheel 53, and a fourth tensioning wheel 54, at the second moveable pulley 132 and the second end of the roller shade fabric winding shaft 1.

In certain embodiments, the movable pulley 13 and the second movable pulley 132, the first winder 41, the second winder 42, the third winder 43, and fourth winder 44, the first tensioning wheel 51, the second tensioning wheel 52, the third tensioning wheel 53, and fourth tensioning wheel 54 are installed in two guide grooves located on each of the first end and the second end of the roller shade fabric winding shaft 1, symmetrically to maintain balance of the adjustable roller shade 100.

In certain embodiments, the gear set 12 and the clutch device 7 are installed on one side of the guide grooves. The third winder 43 is driven by the first winder 41 through a first transmission rod 111 and the fourth winder 44 are driven by the second winder 42 through a second transmission rod 112.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An adjustable roller shade, comprising:

a roller shade fabric winding shaft, wherein a roller shade fabric wound on the roller shade fabric winding shaft forms an upper edge of the adjustable roller shade;

a weight attached to a bottom of the roller shade fabric forming a lower edge of the adjustable roller shade;

a movable pulley fixedly attached to a first end of the roller shade fabric winding shaft; a traction rope wound around the movable pulley, wherein the traction rope comprises an upward lifting section, a first connecting section, a downward pulling section, and a second connecting section forming a closed loop; and a first winder and a second winder, wherein the upward lifting section goes from the first winder, under the movable pulley, connects to the first connecting section over the second winder, the first connecting section connects to the downward pulling section under a second tensioning wheel, the downward pulling section goes over the movable pulley, connects to the second connecting section under a first tensioning wheel, the second connecting section connects to the upward lifting section over the first winder, forming a complete loop, wherein the first winder is driven by a driving motor, and a controller received commands from a control device to control a clutch device, a gear set, and the driving motor for operating the upper edge and the lower edge of the adjustable roller shade, independently, wherein the control device comprises: a control switch and a remote control, wherein the remote control comprises: a first up button and a first down button configured to control the upper edge of the adjustable roller shade, a second up button and a second down button configured to control the lower edge of the adjustable roller shade, a one-key open button configured to open the adjustable roller shade completely by pressing only one key, and one-key close button configured to close the adjustable roller shade completely by pressing only one key.

2. The adjustable roller shade according to claim 1, wherein the traction rope comprises: a rope, or a bead chain, or a belt, or combinations thereof.

3. The adjustable roller shade according to claim 1, wherein when the second winder is engaged with the first winder through the clutch device, the second winder is driven by the engaged first winder, when the second winder is engaged with the gear set through the clutch device, the second winder rotates passively due to the closed loop traction rope, and the gear set and the clutch device are controlled by the controller.

4. The adjustable roller shade according to claim 3, wherein the adjustable roller shade is operated by a user using the control device and the upper edge and the lower edge of the adjustable roller shade may be adjusted separately and independently.

5. The adjustable roller shade according to claim 3, wherein when the user adjusts the lower edge the adjustable roller shade to go up or down, the first winder is disengaged with the second winder, and the second winder is engaged with the gear set through the clutch device, when the first winder is driven by the driving motor to rotate clockwise and the second winder rotates counter-clockwise due to the close loop of the traction rope, the traction rope causes the movable pulley to rotate counter-clockwise and the roller shade fabric rolls in counter-clockwise direction around the roller shade fabric winding shaft, and the lower edge of the adjustable roller shade rises; and when the first winder is driven by the driving motor to rotate counter-clockwise and the second winder rotates clockwise due to the close loop of the traction rope, the traction rope causes the movable pulley to rotate clockwise and the roller shade fabric rolls in clockwise direction around the roller shade fabric winding shaft, and the lower edge of the adjustable roller shade lowers.

6. The adjustable roller shade according to claim 3, wherein when the first winder is engaged with the second winder through the clutch device, when the first winder is driven by the driving motor to rotate clockwise, the second winder is driven by the first winder through the clutch device to rotate clockwise simultaneously, the upward lifting section of the traction rope lengthens, and the traction rope causes the movable pulley to move downward, and the upper edge of the adjustable roller shade lowers; and when the first winder is driven by the driving motor to rotate counter-clockwise, the second winder is driven by the first winder through the clutch device to rotate counter-clockwise simultaneously, the upward lifting section of the traction rope shortens, and the traction rope causes the movable pulley to move upward, and the upper edge of the adjustable roller shade rises.

7. The adjustable roller shade according to claim 1, wherein a second movable pulley is fixedly attached to a second end of the roller shade fabric winding shaft;

a second traction rope goes through a third winder, a fourth winder, a third tensioning wheel, and a fourth tensioning wheel, at the second movable pulley and the second end of the roller shade fabric winding shaft;

the movable pulley and the second movable pulley, the first winder, the second winder, the third winder, and fourth winder, the first tensioning wheel, the second tensioning wheel, the third tensioning wheel, and fourth tensioning wheel are installed in two guide grooves located on each of the first end and the second end of the roller shade fabric winding shaft, symmetrically to maintain balance of the adjustable roller shade; and the gear set and the clutch device are installed on one side of the guide grooves, the third winder is driven by the first winder through a first transmission rod and the fourth winder are driven by the second winder through a second transmission rod.

* * * * *